US005492041A

United States Patent [19]

Valkanov

[11] Patent Number: 5,492,041

[45] Date of Patent: Feb. 20, 1996

[54] PNEUMATIC EQUIPMENT FOR SYNCHRONOUS PIERCING OF SLITS

[76] Inventor: Rossen I. Valkanov, 14811 La Capelle Rd., La Mirada, Calif. 90638

[21] Appl. No.: 223,666

[22] Filed: Apr. 6, 1994

[51] Int. Cl.[6] ..... B26D 1/09; B26D 3/00

[52] U.S. Cl. ..... 83/133; 83/142; 83/461; 83/620; 83/660; 83/639.1; 83/699.11

[58] Field of Search ..... 83/660, 133, 142, 83/130, 461, 620, 691, 639.1, 699.11

[56] References Cited

U.S. PATENT DOCUMENTS

| | | | |
|---|---|---|---|
| 2,836,212 | 5/1958 | Shaw | 83/620 |
| 3,118,338 | 1/1964 | Barley | 83/461 |
| 3,608,413 | 9/1971 | Borello | 83/142 |
| 3,821,911 | 7/1974 | Seme | 83/620 |
| 3,973,453 | 8/1976 | Tameo | 83/660 |
| 4,030,391 | 6/1977 | Swanson et al. | 83/461 |
| 4,228,709 | 10/1980 | Guzay, Jr. et al. | 83/620 |
| 4,358,979 | 11/1982 | Kurzbach | 83/660 |
| 4,742,746 | 5/1988 | Olsson | 83/133 |

*Primary Examiner*—Kenneth E. Peterson

[57] ABSTRACT

A slitting equipment, piercing various patterns of ventilation slits in thin material, comprising a frame, a main cylinder, auxiliary cylinders, and a plate with knives. Upon an electric impulse from a bag-making machine, to which the present slitting equipment is attached, the auxiliary pneumatic cylinders press and stretch the thin material when the main pneumatic cylinder activates a plate, to which is attached a multitude of cutting knives, up and down the vertical plane. The sharp knives pierce and cut the stretched, thin film in the designed pattern. When the knives have disengaged from the material, the auxiliary cylinders release the film, and the latter is free to move horizontally, while restricted vertically by the top and bottom supports of the machine. As a result of this procedure, ventilation openings have been created simultaneously with the sealing and shaping processes carried on by the bag-making machine, without producing any waste material.

4 Claims, 5 Drawing Sheets

PNEUMATIC EQUIPMENT FOR SYNCHRONOUS PIERCING OF SLITS

BACKGROUND OF THE INVENTION

I. Field of the Invention

This invention relates generally to punching apparatus and more particularly integrates a new concept for slitting thin film without producing waste material.

In the past few decades the packaging industry has widely adopted the polyethylene bags as a very inexpensive and practical alternative to more unexpedient methods of wrapping products. The contemporary use of plastic bags encompasses diverse products, some of which are: scientific apparatuses, garment products, and most importantly food. It is sometimes imperative that, when packaged in polyethylene bags, the products be properly ventilated.

II. Description of the Related Art

Customarily, ventilation is achieved by punching sizable holes in plastic bags, thus allowing air to circulate about the packaged goods. The aforesaid holes are punched by additional equipment, mounted on the frame of a bag-making machine and perforating synchronously with the operations of the latter. This kind of equipment, although having the advantage of integrating the perforating with the sealing and cutting processes, also has the shortcoming of producing waste material while cutting off some of the polyethylene to form the desired openings. Such machines are: U.S. Pat. No. 3,524,368 to Goldman (1970); U.S. Pat. No. 3,236,130 to Robert (1966). The inside parts of the holes are severed by a cutting device, and consequently have to be disposed of in many cumbersome ways. Furthermore, the severed parts of the holes frequently remain attached to the inside of the bag and are latter introduced into the packaged produce. Moreover, such punching devices are easily breakable and require sharpening of the cutting tools. The inconvenience of removing great quantities of waste plastic, the problems related to its lawful disposal, and the discomfort of having polyethylene residues in the packaged products have pushed the packaging industry to look for an alternative form of ventilation openings. The alternative is to stack a considerable number of finished but non-perforated bags from the bag-making machine and to place them on another machine, which would compress the stack and punch small slits into the polyethylene. This method of perforating ventilation slits eliminates most problems related to the undesired polyethylene residues, but considerably increases the time and cost of production. Indeed, with this method, the perforating is not integrated with the other bag-making manipulations, but is a distinct, costly, imprecise, and time-consuming process.

There is, therefore, a need for an auxiliary equipment that would be mounted on and would perforate synchronously with bag-making machines, piercing a desirable quantity of small ventilation slits without producing any residual waste material.

SUMMARY OF THE INVENTION

In general, it is an object of the present invention to provide an apparatus, designed to pierce small slits into thin film, while working synchronously with the bag-making machine, thus overcoming the aforementioned shortcomings of the previous art. More precisely, when the bag-making machine stops the thin material to seal and cut a bag, an electric impulse activates the slitting equipment (mounted a few feet before the sealing and cutting mechanisms), which quickly punctures the ventilation slits and disengages from the material before it starts moving again.

Another object of the present invention is to provide a machine of the above character in which a particularly novel method of stretching the film is employed, thereby directly resulting in precise and clear slits.

Another object of the present invention is to provide a novel type, positioning, and attachment of the perforating knives, thus virtually eliminating the need of sharpening those cutting devices. Indeed, the knives are mounted on a non-vibrating holder and pierce the stretched material without entering in contact with anything else but the thin film. Therefore, the dulling of the knives is insignificant to non-existent. Moreover, the knives are easily replaceable.

Another object of the present invention is to decrease the noise associated with the punching process, by introducing a novel system of dual shock absorbers. When the main cylinder propels the plate with knives toward the material, a resilient shock absorber limits its motion in such a fashion that no vigorous impact results. The upward movement of the cylinder is limited by two similar shock absorbers. The result of these shock absorbers is a very silent machine and a lowered impact on its frame.

Various other features of the method and apparatus of the present invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, wherein.

DESCRIPTION OF THE PREFERRED EMBODIMENT

Figure 1:
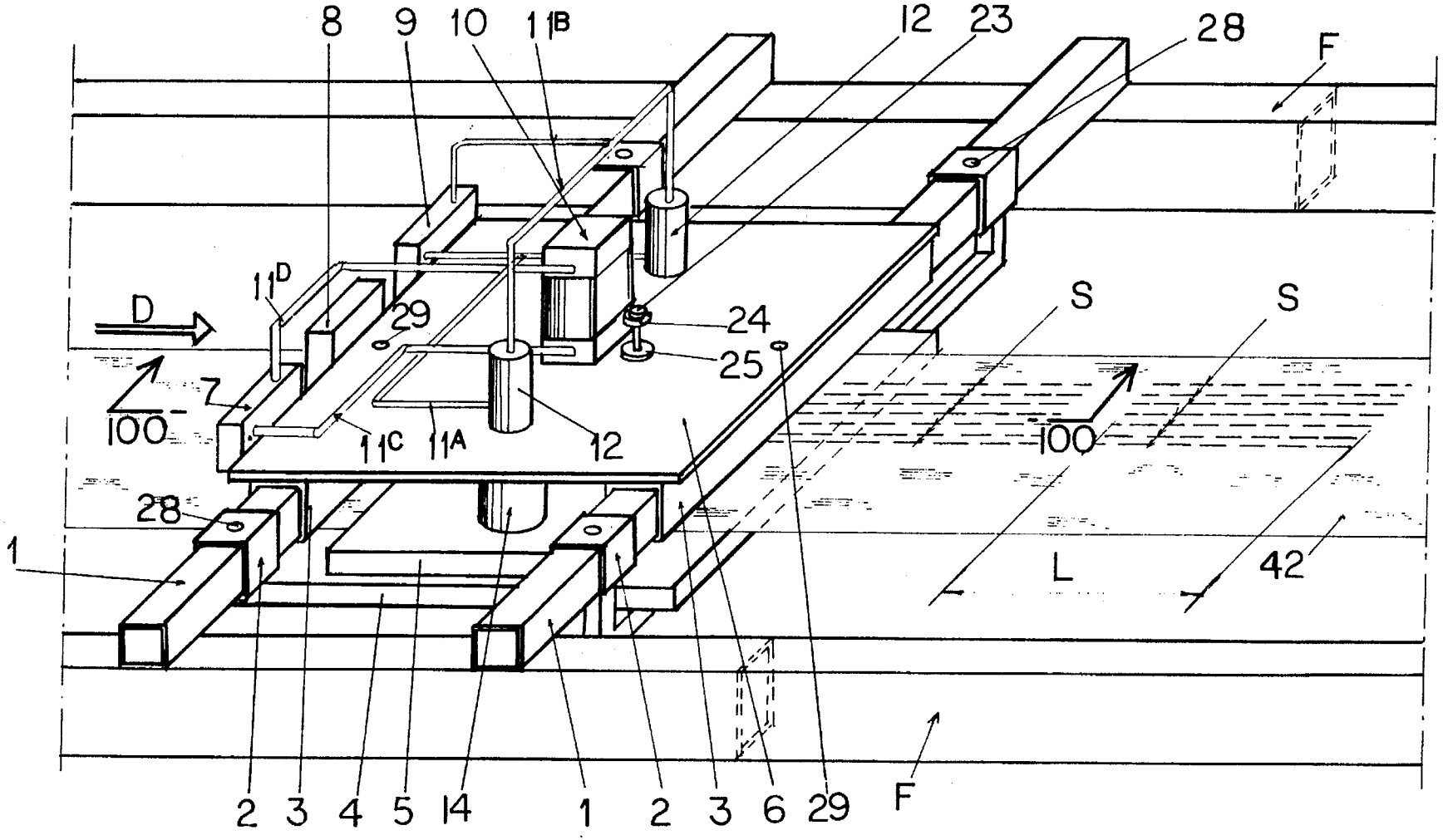
FIG. 1 is a perspective view of the invention, as it would be mounted on the frame of a bag-making machine, with the thin material passing through it.

Reference is now made to FIG. 1, wherein a supporting bridge composed of two square bars 1 is mounted on the frame F of the bag-making machine with which the presented slitting equipment is used. This supporting bridge 1 helps install the slitting machine at the desired spot on the bag-making frame F and is fastened to the latter by four conventional C-clamps (not shown). The square bars constituting the bridge 1 support the entire construction of the apparatus and more particularly the lower frame 2 and the upper frame 3 of the slitting equipment. The lower frame 2 and the upper frame 3 are sliding perpendicularly to the motion D of the thin film 42, and independently of each other, in order to accommodate any slitting location. The lower frame 2, once adjusted to desired position, is immobilized by screws 28. The upper frame 3, once adjusted to desired position, is also immobilized by screws 29. The upper frame 3 supports a platform 6 on which are placed: the knife-activating main air-cylinder 10; the auxiliary film-stretching air-cylinders 12; a standard pneumatic solenoid valve 7 that activates air-cylinder 10; a standard pneumatic solenoid valve 9 that activates the auxiliary air-cylinders 12; and the central electronic processing unit 8 that receives electric impulses from the bag-making machine and synchronizes the movements of air-cylinders 10 and 12. The guide-separator 5 and the auxiliary cylinders 12 are connected by means of two cylindrical rubber bumpers 14, bonded to steel studs, with female threads on both ends, whereas the support-separator 4 is firmly fastened to the lower frame 2 (more details in FIGS. 2–3). The thin film is moving horizontally between the guide-separator 5 and the support separator 4 when its vertical vibration is being restricted by them. The main air-cylinder 10 propels the guide-separator 5 downward toward the support-separator 4 and thus presses, and stretches the temporarily non-moving film. The pattern of slits S and length L of the sliced surface, as shown, are predetermined by the disposition and form of the knives (shown elsewhere).

Figure 2:
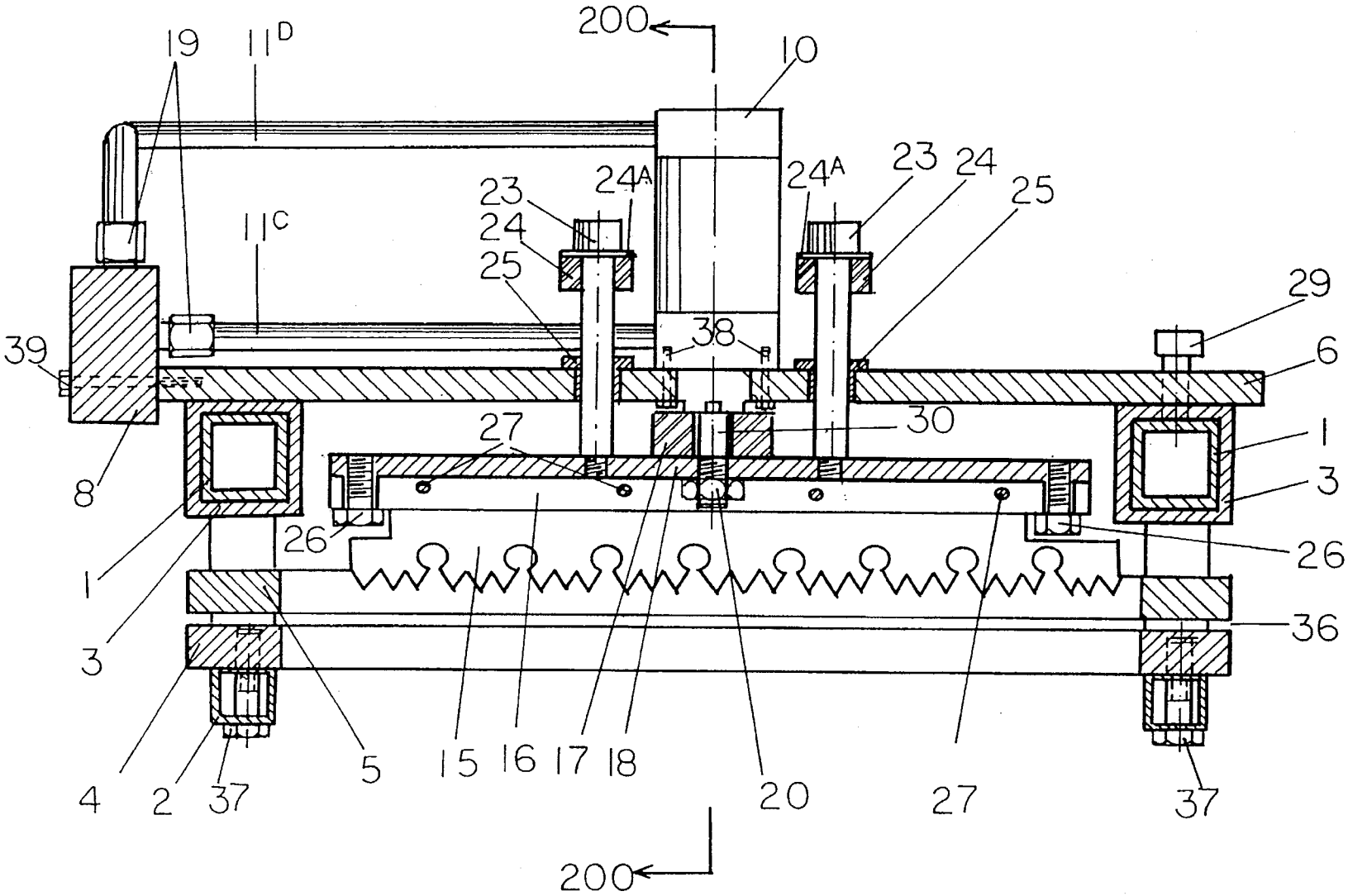
FIG. 2 is a sectional view taken along the line 100—100 of FIG. 1 showing the knives in upper position, when the down-perforating-position is hinted with dotted contours.

Reference is now made to FIG. 2 where the same reference numbers as on FIG. 1 will be found. The knife-activating main air-cylinder 10 is lodged into an opening in platform 6 and is fastened to said platform 6 by means of screws 38. The piston rod 30 of air-cylinder 10 is bolted into a threaded hole of knife-holder 18 and is further secured by means of a nut 20 as shown. A shock absorber 17, made from a resiliently deformable rubber, neoprene or the like, is fitted around the piston rod 30 to reduce shock from the upward movement of the knife-holder 18. Furthermore, two shoulder screws 23, threaded only in the lowest part of the stems, are screwed onto the knife-holder 18 and are serving as guides of the knife-holder. Their unthreaded upper stems are slidably mounted in flange bearings 25 to prevent the knife-holder from vibrating, twisting, or rotating as it moves vertically down and up. The guides 23 are also fitted with shock absorbers 24, similar to the one described in 17, and washers 24A to assure exact horizontal position and noiseless slitting. The shape and the form of the knives 15 would vary depending on the desired specification of the slits, and any two rows of knives are distanced by spacers 16 whose dimensions are also determined by the desired specification of the slits. An entirely threaded rod 27 traverses the knives 15 and spacers 16 and holds them in a pack (more details in FIGS. 4 and 5). The pack of knives is mounted on the knife-holder 18 by means of screws 26. The central electronic processing unit 8 is affixed to platform 6 by means of screws 39.

When the solenoid valve 9 (hidden behind the central electronic processing unit 8) is not activated, compressed air circulates through air-hose 11C, thereby holding the piston rod 30 of air-cylinder 10 in upper position. Upon activation of solenoid valve 9, compressed air is directed to circulate through air-hose 11D, thereby activating air-cylinder 10 downward. The down position of the knives 15 is shown in dotted contours. Almost instantaneously, compressed air resumes circulating through the air-hose 11C, thereby activating the air-cylinder upward and the knives are back in the original, upper position until a new impulse activates solenoid valve 9.

Figure 3:
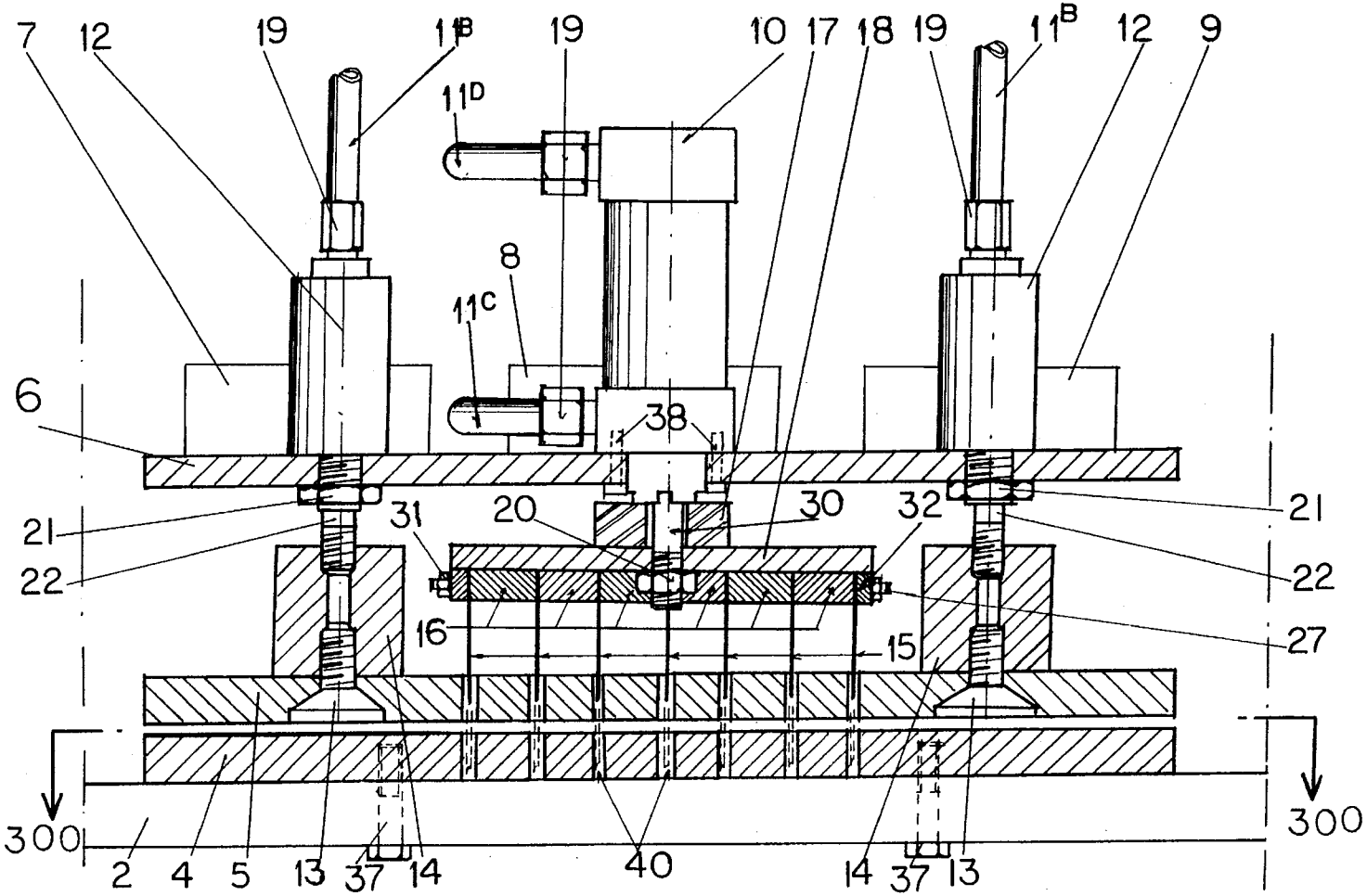
FIG. 3 is a sectional view taken along the line 200—200 of FIG. 2 showing the knives in upper position, when the down-perforating-position is hinted with dotted contours.

FIG. 3 shows the two auxiliary cylinders 12 which are activated before the main cylinder 10. The connection between air hoses 11A, 11B, 11C, 11D and cylinders 10, and 12 is secured by standard air-fittings 19. Cylinders 12 are bolted into a threaded opening in platform 6 and are further secured by a nut 21. The threaded piston rods 22 of cylinders 12 are bolted into cylindrical rubber bumpers 14, bonded to steel studs, with female threads on both ends. The guide-separator 5 is fastened to cylindrical rubber bumpers 14 from the opposite side of piston rods 22 by flat-headed screws 13. Thus, upon activation of cylinders 12, guide-separator 5 presses against support-separator 4, and thereby stretches the thin material found between the two plates. A fraction of a second later, the activation of cylinder 10 propels the knives 15 through prolonged orifices 40 of guide-separator 5, pierces the stretched material, and enters into prolonged orifices 40 of support-separator 4. The down position of the knives, as they move through the prolonged orifices 40, is represented by dotted lines. The support-separator 4 is fastened to the lower frame 2 by means of screws 37 and always remains immobile.

Figure 4:
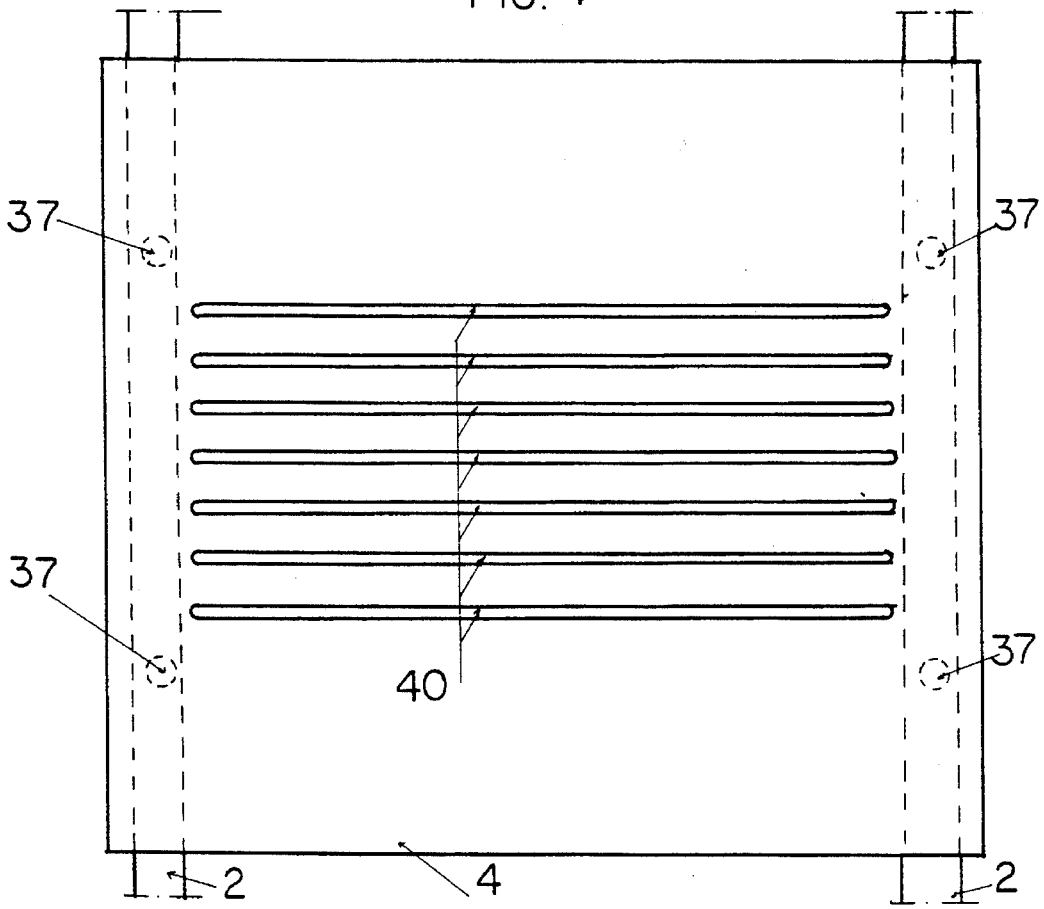
FIG. 4 is a sectional view taken along the line 300—300 of FIG. 3.

FIG. 4 gives a clear perspective of support-separator 4. Screws 37 are bolted into threaded holes of support-separator 4, thereby fastening the latter to lower frame 2. Prolonged orifices 40, excavated into support-separator 4, are commensurate to ensure frictionless vertical movement of the knives 15, as explained in FIG. 3. The prolonged orifices of guide-separator 5 are analogous in shape and position to those of support-separator 4.

Figure 5:
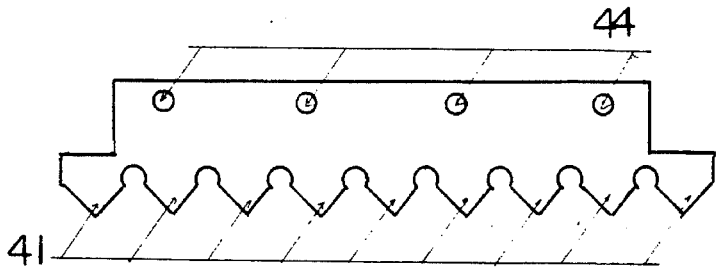
FIG. 5 is a detailed side elevation view of a knife.
Figure 6:
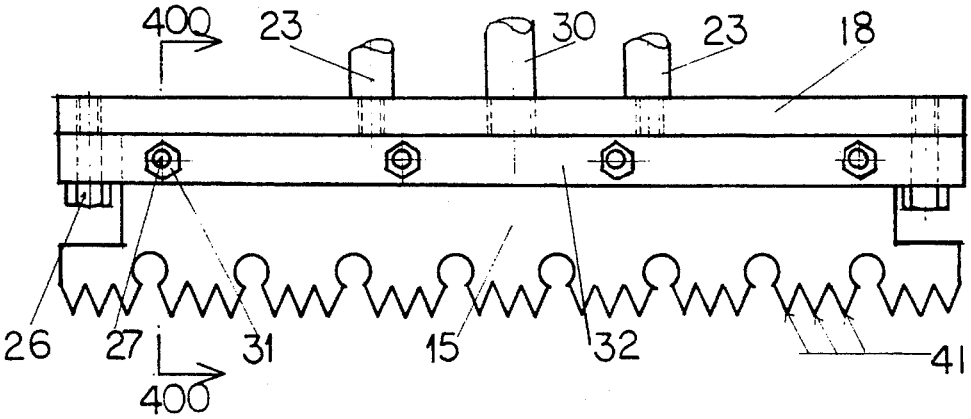
FIG. 6 is an enlarged side elevation view of the knives, shown with a slightly different teeth arrangement from FIG. 5, and their attachment to the machine.
Figure 7:
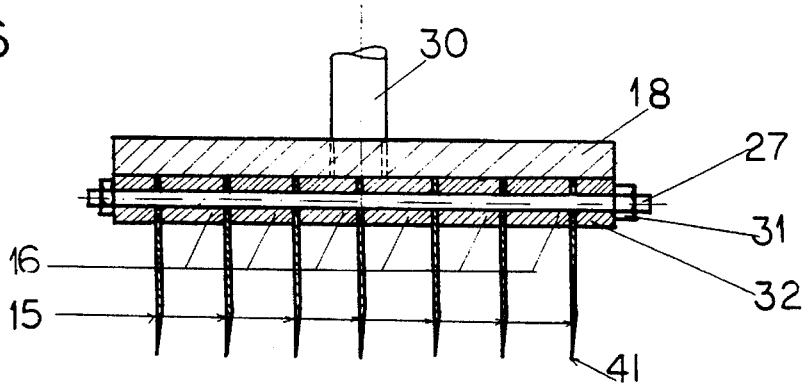
FIG. 7 is a sectional view of the knives along the line 400—400 of FIG. 6.

FIGS. 5–7 show the knives 15 in detail. The represented cutting devices 15 are a mere example of knives mountable on this slitting equipment. In fact, their shape, teeth 41 and thickness would vary with the specifications of the slits, as required by the manufacturer of plastic bags. One example of a knife is represented in FIG. 5, whereas another example, with different arrangement of teeth, is depicted in FIG. 6. The knives have round openings 44 in their upper part and when placed between the spacers 16, they are traversed in openings 44 by rods 27 with threaded ends. The rods 27 fasten and compress the knives and the spacers in position by means of nuts 31 on both ends, as shown in FIGS. 6 and 7. Notice, the outer spacers 32 are made from more rigid material and their size should complement the dimensions of the particular knife configuration. Once the knives are fastened between spacers 16 and 32, the assembly is attached by means of bolts 26, to threaded holes of knife-holder 18, as shown in FIG. 6.

Figure 8:
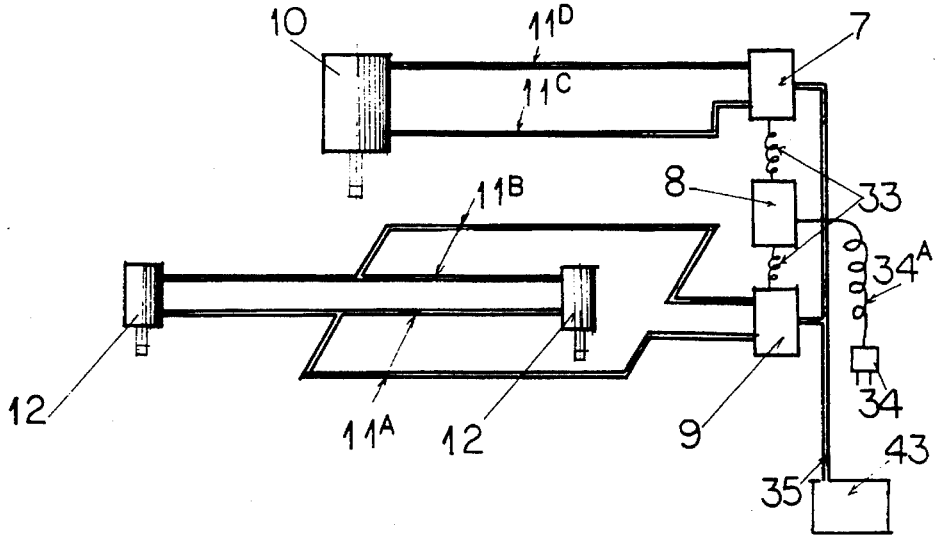
FIG. 8 is schematic representation of the air supply, electrical supply, and air-cylinders control.

FIG. 8 is a schematic representation of the air and power supply of the slitting equipment. If the thin material is moving between the frame of a bag-making machine, the solenoid valves 7 and 9 are closed. Compressed air, supplied by an air source 43 and a duct 35, is passing through air-hoses 11C and 11A, thereby holding the piston rods of cylinders 10 and 12 respectively in upper position. When the bag-making machine immobilizes the thin material in order to seal and cut a bag, it emits an electric impulse, intended to synchronize the functioning of any auxiliary attachments with its operations. A plug 34 is connected to a standard outlet of the bag-making machine, and the impulse is sent through the electric wire 34A in the central electric processing unit 8. Upon receiving an impulse, the unit 8 sends an electric signal to the solenoid valve 9 which redirects the compressed air through air-hose 11B, and thus activates the piston rods of auxiliary cylinders 12 down the vertical plane, thereby pressing and stretching the immobile material, as was previously explained. Five thousandths of a second after activating solenoid valve 9, the unit 8 sends an electric signal to solenoid valve 7 which redirects compressed air through air-hoses 11D to activate the piston rod of main cylinder 10, thereby propelling the knives attached onto it to slit the previously stretched material. After the electric signal, solenoid valves 7 and 9 return to closed position, and compressed air is again passing through air-hoses 11C and 11A, thereby propelling and holding the piston rods of cylinders 10 and 12, respectively, in upper position. The present slitting equipment releases the film long before the bag-making machine completes the cutting and sealing. The entire piercing procedure takes no loner than a small fraction of a second, depending on length of the impulse of the bag-making machine.

It is well understood that those skilled in the art may modify or change the illustrated embodiment as shown or described, or replace certain elements of this embodiment by equivalents without departing from the basic concept of the invention, as defined by the appended claims.

I claim:

1. A piercing apparatus comprising:

a supporting bridge, an upper frame, a lower frame, a platform affixed to said upper frame, a central electronic processing unit, receiving electric signals from an external source, and emitting timed electric signals, a pneumatic main cylinder mounted on the said platform, a pneumatic main solenoid valve, when opened, allowing pressured air, conveyed by means of air-hoses, to activate said main cylinder, auxiliary pneumatic cylinders mounted on said platform, a pneumatic auxiliary solenoid valve, when opened, allowing pressured air, conveyed by means of air-hoses, to activate said auxiliary cylinders, a pack of knives, comprising several knives distanced by means of spacers and fastened by means of rods to form an assembly, each knife having plural piercing elements, said assembly being attached to said pneumatic main cylinder to restrict the assembly to upward and downward motion, said downward motion having limiting means such that said plural piercing elements form plural, unconnected slits in a workpiece, a guide-separator with prolonged orifices allowing for vertical movement of said pack of knives thru said guide-separator orifices, said guide-separator is connected to and vertically activated by said auxiliary cylinders, a support separator with prolonged orifices allowing for vertical movement of said pack of knives in said support-separator orifices, said support-separator is fastened to said lower frame.

2. Piercing apparatus as claimed in claim 1 in which:

said central electronic processing unit, upon an electric signal, opens said pneumatic auxiliary solenoid valve and allows compressed air, conveyed by means of air-hoses, to drive said auxiliary pneumatic cylinders down, thus propelling said guide-separator down toward said support-separator, said central electronic processing unit, after propelling said guide-separator down, opens said main solenoid valve and allows compressed air, conveyed by means of air-hoses, to drive said main pneumatic cylinder rod down, thus propelling said knife pack, attached to a main cylinder rod, through said prolonged orifices of said guide-separator and said support-separator.

3. Piercing apparatus as claimed in claim 1 in which said pack of knives if further characterized by round openings at each extremity, enabling said knife pack to be connected to said main cylinder rod by a plate-holder and bolts.

4. Piercing apparatus as claimed in claim 1 in which said knife pack is parallel to said guide-separator and is restricted from twisting and rotating by means of guides, enveloped by a resilient matter, thereby limiting the downward motion of said knife pack, reducing impact and decreasing noise, the main cylinder rod is enveloped by a resilient matter, thereby limiting the upward motion of said knife pack, reducing impact, and decreasing noise.

* * * * *